US011167335B2

(12) United States Patent
Kawamoto et al.

(10) Patent No.: US 11,167,335 B2
(45) Date of Patent: Nov. 9, 2021

(54) METHOD FOR PRODUCING PIPE MATERIAL

(71) Applicant: MITSUBISHI HEAVY INDUSTRIES, LTD., Tokyo (JP)

(72) Inventors: Hiroshi Kawamoto, Tokyo (JP); Toyoaki Yasui, Tokyo (JP); Yoichi Sano, Tokyo (JP); Yoshihiro Kiyota, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 373 days.

(21) Appl. No.: 16/095,533

(22) PCT Filed: Jun. 12, 2017

(86) PCT No.: PCT/JP2017/021697
§ 371 (c)(1),
(2) Date: Oct. 22, 2018

(87) PCT Pub. No.: WO2018/012177
PCT Pub. Date: Jan. 18, 2018

(65) Prior Publication Data

US 2019/0105695 A1 Apr. 11, 2019

(30) Foreign Application Priority Data

Jul. 12, 2016 (JP) ..... JP2016-137597

(51) Int. Cl.
*B21D 9/16* (2006.01)
*B21D 9/04* (2006.01)
(Continued)

(52) U.S. Cl.
CPC ..... *B21D 9/16* (2013.01); *B21D 7/022* (2013.01); *B21D 9/04* (2013.01); *B21D 9/125* (2013.01); *B21D 9/18* (2013.01); *B21D 37/18* (2013.01)

(58) Field of Classification Search
CPC ... B21D 9/15; B21D 9/16; B21D 9/00; B21D 9/04; B21D 9/12; B21D 7/02; B21D 7/022
See application file for complete search history.

(56) References Cited

U.S. PATENT DOCUMENTS 2,777,500 A * 1/1957 Ekholm ..... B21D 9/15 72/57
3,105,537 A * 10/1963 Foster ..... B21D 9/05 72/57
(Continued)

FOREIGN PATENT DOCUMENTS

CN 103459057 A 12/2013
CN 103861912 A 6/2014
(Continued)

OTHER PUBLICATIONS

JP55 126324 Nakada, et alia (Sep. 30, 1980) machine translation (Year: 1980).*
(Continued)

*Primary Examiner* — Adam J Eiseman
*Assistant Examiner* — Fred C Hammers
(74) *Attorney, Agent, or Firm* — Manabu Kanesaka; Benjamin Hauptman; Kenneth Berner

(57) ABSTRACT

The purpose of the present invention is to provide a method for producing a pipe material and to provide a mandrel with which resistance between a member to be processed and the mandrel during bending processing can be reduced and overall processing time can be shortened. The method for producing a pipe material includes: a step for inserting a
(Continued)

mandrel, which is provided on the inside thereof with a flow path through which dry ice powder flows and spray holes at the tip thereof for spraying the dry ice powder, inside pipe material; a step for spraying the dry ice powder from the spray holes inside the pipe material; and a step for performing bending processing on the pipe material wherein the mandrel has been inserted.

6 Claims, 3 Drawing Sheets

(51) Int. Cl.

| | |
|---|---|
| ***B21D 9/18*** | (2006.01) |
| ***B21D 7/022*** | (2006.01) |
| ***B21D 9/12*** | (2006.01) |
| ***B21D 37/18*** | (2006.01) |

(56) References Cited

U.S. PATENT DOCUMENTS

| | | | | | |
|---|---|---|---|---|---|
| 4,332,073 | A | * | 6/1982 | Yoshida | B21C 37/154 138/140 |
| 4,377,894 | A | * | 3/1983 | Yoshida | B23P 11/025 138/140 |
| 5,331,832 | A | * | 7/1994 | Cherian | B21D 26/14 72/430 |
| 5,353,617 | A | * | 10/1994 | Cherian | B21D 26/14 29/419.2 |
| 5,497,809 | A | | 3/1996 | Wolf | |
| 5,555,762 | A | * | 9/1996 | Kawamura | B21D 9/15 72/369 |
| 8,978,433 | B2 | | 3/2015 | Kamitani et al. | |
| 2001/0037573 | A1 | * | 11/2001 | Kuschel | B21C 37/29 29/890.148 |
| 2009/0071222 | A1 | | 3/2009 | Iida et al. | |
| 2016/0030991 | A1 | * | 2/2016 | Bombino | F16L 1/20 72/369 |

FOREIGN PATENT DOCUMENTS

| | | | | |
|---|---|---|---|---|
| CN | 103909125 | A | | 7/2014 |
| CN | 105478551 | A | | 4/2016 |
| DE | 10202201 | | * | 1/2002 |
| DE | 10202201 | A1 | | 7/2003 |
| EP | 1256394 | A2 | | 11/2002 |
| JP | 55126324 | | * | 9/1980 |
| JP | S57-152320 | A | | 9/1982 |
| JP | S59145727 | | * | 10/1984 |
| JP | 05320744 | | * | 5/1992 |
| JP | H05 320744 | A | * | 5/1992 |
| JP | H07-039942 | A | | 2/1995 |
| JP | H10-328745 | A | | 12/1998 |
| JP | 2004-322204 | A | * | 4/2003 |
| JP | 2004322204 | | * | 4/2003 |
| JP | 2004 351439 | A | * | 12/2004 |
| JP | 2004351439 | | * | 12/2004 |
| JP | 2006-247664 | A | | 9/2006 |
| JP | 2006-263793 | A | | 10/2006 |
| JP | 2010 094715 | A | * | 10/2008 |
| JP | 2010094715 | | * | 10/2008 |
| JP | 2009-072804 | A | | 4/2009 |
| WO | 2012/096392 | A1 | | 7/2012 |

OTHER PUBLICATIONS

JPS 59 145727 A Shiritani (Aug. 21, 1984) machine translation (Year: 1984).*

DE10202201 Hasenmaier (Jan. 22, 2002) machine translation (Year: 2002).*

JP 2004-322204 A (Apr. 28, 2003) Okagawa machine translation (Year: 2003).*

JP 2004 351439 A Nakajima, et alia (Dec. 16, 2004) machine translation (Year: 2004).*

JP 2010 094715 A Fuminori (Oct. 17, 2008) machine translation (Year: 2008).*

JPH05 320744 A Tanaka (May 18, 1992) machine translation (Year: 1992).*

Europe Patent Office, "Search Report for European Patent Application No. 17827309.0," dated Mar. 6, 2019.

PCT/ISA/210, "International Search Report for International Application No. PCT/JP2017/021697," dated Aug. 8, 2017.

China Patent Office, "Office Action for Chinese Patent Application No. 201780028496.5," dated Sep. 9, 2019.

Liu, J., "Turning of Stainless Steels," Machinery Industry Press, Feb. 28, 1981, p. 29-31.

* cited by examiner

METHOD FOR PRODUCING PIPE MATERIAL

RELATED APPLICATIONS

The present application is National Phase of International Application No. PCT/JP2017/021697 filed Jun. 12, 2017, and claims priority from Japanese Application No. 2016-137597, filed Jul. 12, 2016, the disclosure of which is hereby incorporated by reference herein in its entirety.

TECHNICAL FIELD

The present invention relates to a method for producing a pipe material.

BACKGROUND ART

When bending processing is performed on a pipe material, in order to prevent cross-sectional deformation and deformation such as wrinkles in a processing portion of the pipe material, a nest or a mandrel may be inserted into the pipe material. For such a purpose, a method of processing a pipe material using the nest or mandrel inserted into the pipe material is disclosed in PTL 1 or PTL 2.

In PTL 1, a plastic bag is inserted into a hollow portion of a bending processing portion of an aluminum hollow-shaped material, the inserted plastic bag is filled with water, a mouth of the plastic bag is closed with a fastener such as rubber, the plastic bag is frozen to freeze the water in the plastic bag, and an ice nest is formed in a state where the hollow portion of the bending processing portion is filled with ice. In addition, in PTL 2, when bending processing is performed on a metal pipe, after a mandrel is inserted into the metal pipe, the bending processing is performed while a lubricant is supplied from an oil supply nozzle to a contact portion between the metal pipe and the oil supply nozzle, and a resistance between the metal pipe and the mandrel is reduced during the bending processing.

CITATION LIST

Patent Literature

[PTL 1] Japanese Unexamined Patent Application Publication No. 10-328745

[PTL 2] Japanese Unexamined Patent Application Publication No. 7-39942

SUMMARY OF INVENTION

Technical Problem

However, PTL 1 is intended to facilitate attachment and detachment of the nest, a friction between the hollow molded material and the nest during the bending processing is not considered, a friction between a workpiece and an insertion member increases during the bending processing, and thus, the frictions may cause distortion and cracking in the processing portion.

In addition, in PTL 2, the lubricant in the metal pipe should be removed after the bending processing, it takes time to wash for removal, and accordingly, the overall processing time is lengthened.

The present invention is made in consideration of the above-described circumstances, and an object thereof is to provide a method for producing pipe material and a mandrel capable of shortening overall processing time while reducing the resistance between the workpiece and the mandrel during the bending processing.

Solution to Problem

In order to achieve the above-described object, a method for producing a pipe material and a mandrel of the present invention adopt the following means.

That is, according to an aspect of the present invention, there is provided a method for producing a pipe material including: an insertion step of inserting a mandrel into a pipe material; an injection step of injecting dry ice powder into the pipe material; and a bending processing step of performing bending processing on the pipe material into which the mandrel is inserted.

In the above-described configuration, the dry ice powder is injected into the pipe material and the bending processing is performed on the pipe material. If the dry ice powder is injected into the pipe material, the dry ice powder adheres to an inner surface of the pipe material and a surface of the mandrel, and a film of the dry ice powder is formed. Accordingly, a resistance generated between the inner surface of the pipe material and the surface of the mandrel during the bending processing is reduced by the dry ice powder, and thus, it is possible to prevent distortion or cracking from occurring in a processing portion due to a friction between the inner surface of the pipe material and the surface of the mandrel.

In addition, a bending processing portion of the pipe material generates heat by plastic deformation of the pipe material during the bending processing. However, the film of the dry ice powder is formed inside the pipe material, and thus, the dry ice powder absorbs the generated heat to suppress an increase in temperature of the processing portion. Accordingly, it is possible to prevent burning of the inner surface of the pipe material caused by the heat generated by the plastic deformation.

In addition, the dry ice powder is easily vaporized, and thus, the dry ice powder is vaporized inside the pipe material after the bending processing. Accordingly, a liquid or solid residue is not generated in the pipe material, a step of removing a lubricant from the inside of the pipe material after the bending processing can be omitted, and thus, overall processing time can be shortened.

In addition, the dry ice powder is injected to the processing portion, and even in a case where foreign materials such as chips are present in the processing portion in the pipe material, the foreign materials can be removed from the processing portion by the injection of the dry ice powder. Accordingly, even in a case where the foreign materials or the like are mixed in the pipe material, it is not necessary to wash the inside of the pipe material, and a step of removing the foreign materials can be omitted.

In addition, in the method for producing a pipe material according to the aspect of the present invention, in the bending processing step, the dry ice powder may be continuously injected.

In the above-described configuration, the dry ice powder is continuously injected during the bending processing. Accordingly, the dry ice powder is always supplied to the bending processing portion during the bending processing. Accordingly, the heat of the bending processing portion generated during the bending processing is reliably absorbed by the dry ice powder, and thus, it is possible to reliably prevent the burning of the processing portion.

Moreover, the method for producing a pipe material according to the aspect of the present invention may further include an injection stop step of stopping injection of the dry ice powder, in which the insertion step may include a first insertion step of inserting the mandrel up to a portion positioned in front of a processing portion of the pipe material to be subjected to the bending processing, the injection step may include a preceding injection step of injecting the dry ice powder to the processing portion inside the pipe material from the portion positioned in front of the processing portion after the first insertion step, the injection stop step may include a step of stopping the injection of the dry ice powder after the preceding injection step, and the insertion step may include a second insertion step of inserting the mandrel into the processing portion after the injection stop step.

In the above-described configuration, the insertion of the mandrel is stopped in front of the processing portion, the dry ice powder is injected to the processing portion, the injection of dry ice powder is stopped, and thereafter, the mandrel is inserted into the processing portion. Accordingly, after a layer of the dry ice powder is reliably formed on the inner surface of the pipe material of the processing portion, the mandrel can be inserted into the processing portion. Accordingly, the resistance generated between the inner surface of the pipe material and the surface of the mandrel during the bending processing is appropriately reduced by the dry ice powder, and thus, it is possible to prevent the burning of the inner surface of the pipe material.

In addition, the bending processing is performed after the injection of the dry ice powder is stopped, and thus, a consumption amount of the dry ice powder can be reduced.

In addition, in the method for producing a pipe material according to the aspect of the present invention, the mandrel may include a flow path, through which the dry ice powder flows, inside the mandrel, and an injection hole, through which the dry ice powder is injected, on a tip of the mandrel.

In the above-described configuration, the dry ice powder flows through the flow path inside the mandrel, and the dry ice powder can be injected from the injection hole to the inside of the pipe material. Accordingly, it is not necessary to provide means for injecting the dry ice powder separately from the mandrel.

In addition, according to another aspect of the present invention, there is provided a mandrel which is inserted into a pipe material when bending processing is performed on the pipe material, including: a flow path, through which the dry ice powder flows, inside the mandrel; and an injection hole, through which the dry ice powder is injected, on a tip of the mandrel.

In the above-described configuration, the mandrel includes the flow path through which the dry ice powder flows and an injection hole through which the dry ice powder is injected. Accordingly, the dry ice powder is injected to a portion between the pipe material and the mandrel, and the bending processing can be performed on the pipe material. If the dry ice powder is injected to the portion between the pipe material and the mandrel, the dry ice powder adheres to the inner surface of the pipe material and the surface of the mandrel, and the film of the dry ice powder is formed. Accordingly, the resistance generated between the inner surface of the pipe material and the surface of the mandrel during the bending processing is reduced by the dry ice powder, and thus, it is possible to prevent distortion or cracking from occurring in the processing portion due to a friction between the inner surface of the pipe material and the surface of the mandrel.

In addition, a bending processing portion of the pipe material generates heat by plastic deformation of the pipe material during the bending processing. However, the film of the dry ice powder is formed inside the pipe material, and thus, the dry ice powder absorbs the generated heat to suppress an increase in temperature of the processing portion, and it is possible to prevent the burning caused by the heat generated by the plastic deformation.

In addition, the dry ice powder is vaporized at the room temperature, and thus, the dry ice powder is vaporized after the bending processing. Accordingly, a residue is not generated, a step of removing a lubricant after the bending processing can be omitted, and thus, a bending processing time can be shortened.

In addition, the dry ice powder is injected to the processing portion, and even in a case where foreign materials or the like are present in the processing portion, the foreign materials can be removed from the processing portion by the injection of the dry ice powder.

In addition, in the mandrel according to the aspect of the present invention, a coating portion having sliding properties better than those of a surface of the mandrel may be formed on the surface of the mandrel.

In the above-described configuration, the coating portion having favorable sliding properties is formed on the surface of the mandrel, and thus, even when the dry ice powder is not injected and the film of the dry ice powder is not formed on the mandrel, the mandrel can have favorable sliding properties. Accordingly, even in situations in which the dry ice powder cannot be injected, it is possible to reduce the resistance generated between the inner surface of the pipe material and the surface of the mandrel, and it is possible to prevent distortion or cracking from occurring in the processing portion due to the friction between the inner surface of the pipe material and the surface of the mandrel.

In addition, in the mandrel according to the aspect of the present invention, a porous coating portion may be formed on the surface of the mandrel.

In the above-described configuration, the porous coating portion is formed on the surface of the mandrel. Accordingly, the dry ice powder injected from the mandrel is reliably held by the porous coating portion. Therefore, the film of the dry ice powder is reliably formed on the surface of the mandrel, and thus, the resistance generated between the inner surface of the pipe material and the surface of the mandrel is reduced, and it is possible to prevent the distortion or cracking from occurring in the processing portion due to the friction between the inner surface of the pipe material and the surface of the mandrel.

Advantageous Effects of Invention

According to the present invention, it is possible to shorten overall processing time while reducing a resistance between a workpiece and a mandrel during the bending processing.

DESCRIPTION OF EMBODIMENTS

Hereinafter, a first embodiment according to the present invention will be described with reference to the drawings.

First Embodiment

Hereinafter, the first embodiment of the present invention will be described with reference to FIGS. 1 to 3B.

Figure 1:
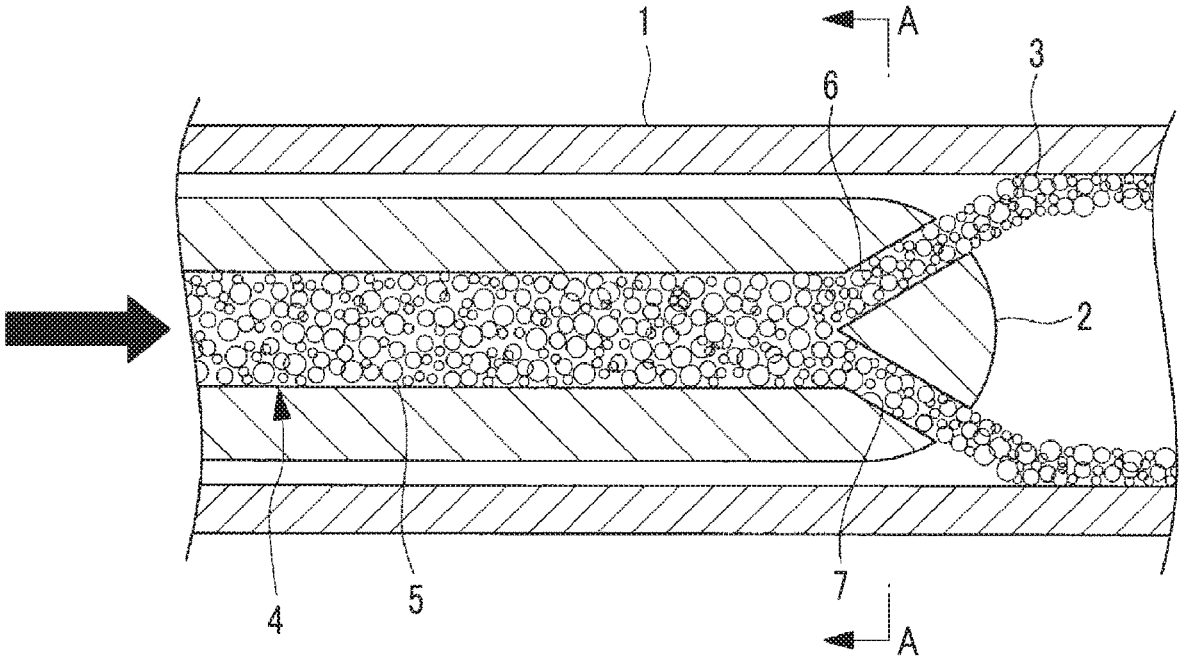
FIG. 1 is a longitudinal sectional view schematically showing a state where a mandrel according to a first embodiment of the present invention injects dry ice powder into a pipe material.
Figure 2:
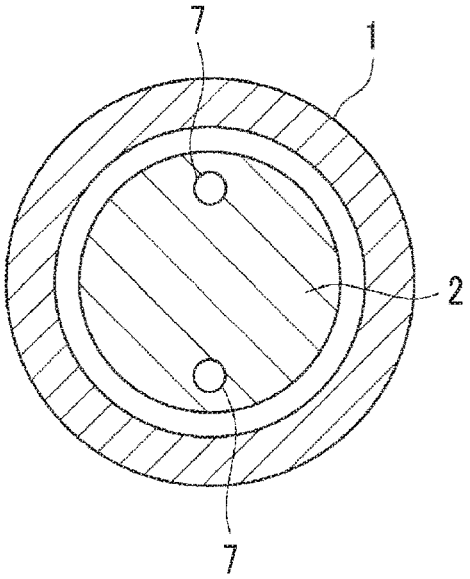
FIG. 2 is a sectional view taken along line A-A in FIG. 1.

As shown in FIGS. 1 and 2, a mandrel 2 to be inserted into a pipe material 1 is formed of aluminum, bronze, iron or the like and has a substantially cylindrical shape whose outer diameter is slightly smaller than an inner diameter of the pipe material 1, and one end which becomes a tip of the mandrel 2 is formed in a hemispherical shape. A flow path 4, through which dry ice powder 3 stored in a dry ice powder storage portion (not shown) flows, is formed inside the mandrel 2. The flow path 4 includes a main flow path 5 which extends from the dry ice powder storage portion to the tip portion of the mandrel 2 approximately in parallel to a surface of the mandrel 2 and two split flow paths 6 which extend to be inclined by approximately 30° with respect to the main flow path 5 from a downstream end of the main flow path 5. Each of the split flow paths 6 linearly extends to the surface of the mandrel 2. An injection hole 7 is formed at a tip portion on the surface of the mandrel 2 which is a downstream end of each split flow path 6. Each injection hole 7 is positioned on a hemispherical portion of the tip of the mandrel 2. In addition, in the present embodiment, the angle between the main flow path 5 and each of the split flow paths 6 is approximately 30°. However, the angle between the main flow path 5 and each of the split flow paths 6 is not limited to this. Any angle may be adopted as long as the dry ice powder 3 can be injected, and for example, the angle may be 90°. In addition, in the present embodiment, the two injection holes 7 are formed. However, the number of the injection holes 7 may be one, or may be three or more. In addition, a position at which each injection hole 7 is provided may be a base portion side (a side opposite to the tip) from the hemispherical portion of the tip of the mandrel 2.

Next, a method for processing the pipe material 1 using the above-described mandrel 2 will be described with reference to FIGS. 1, 3A, and 3B. In addition, for the sake of convenience of descriptions, in FIGS. 3A and 3B, the dry ice powder 3, the flow path 4 inside the mandrel 2, or the like are not shown.

Figure 3A:
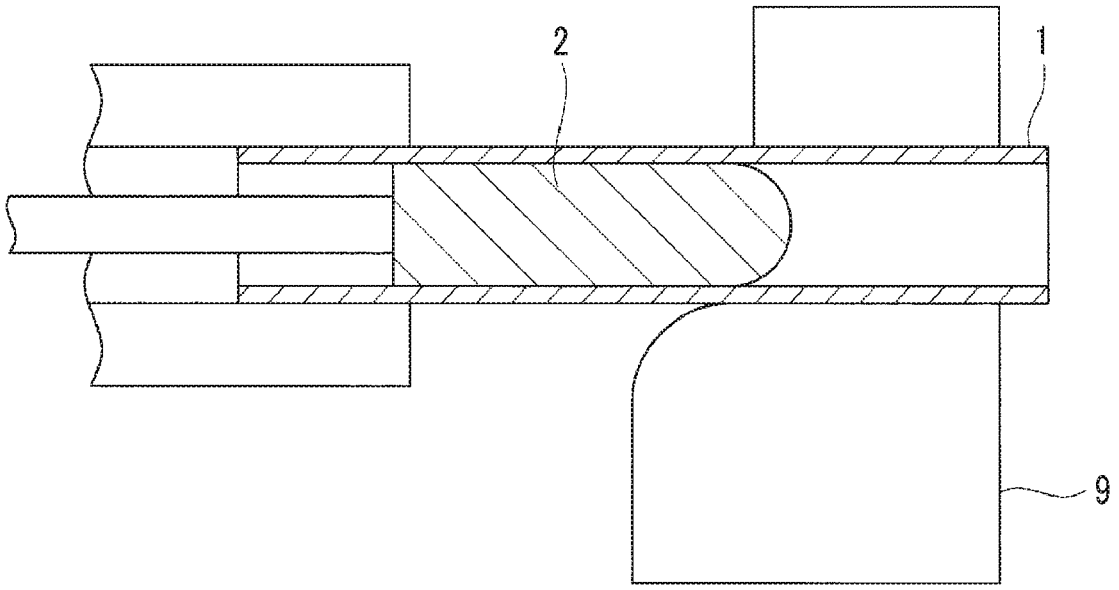
FIG. 3A is a view showing a state of bending processing of the pipe material in FIG. 1 and shows a state before the bending processing.

First, as shown in FIGS. 1 and 3A, the mandrel 2 is inserted into the pipe material 1 and the insertion of the mandrel 2 is stopped if the mandrel 2 reaches the processing portion of the pipe material 1. In this case, a clearance of approximately 50 μm to 100 μm is generated between the inner surface of the pipe material 1 and the surface of the mandrel 2 (refer to FIGS. 1 and 2). Next, the dry ice powder 3 stored in the dry ice powder storage portion flows in an arrow direction of FIG. 1 in the flow path 4 inside the mandrel 2, and the dry ice powder 3 is injected to a portion between the inner surface of the pipe material 1 and the surface of the mandrel 2 from each injection hole 7 formed on the surface of the mandrel 2.

Figure 3B:
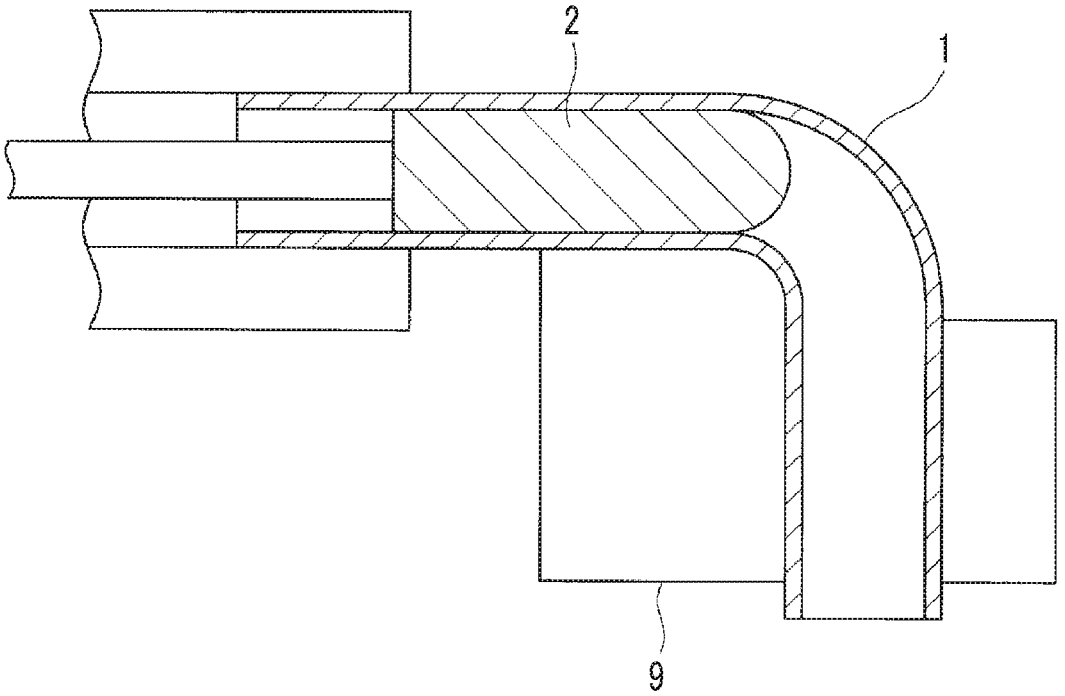
FIG. 3B is a view showing the state of the bending processing of the pipe material in FIG. 1 and shows a state after the bending processing.

In addition, as shown in FIGS. 3A and 3B, bending processing is performed on the pipe material 1, to which the mandrel 2 is inserted, using a processing device 9. In this case, the bending processing of the pipe material is performed along the tip portion of the mandrel 2 (refer to FIG. 3B). If the bending processing ends, the injection of the dry ice powder 3 stops, and the mandrel 2 is extracted from the inside of the pipe material 1. In addition, in the present embodiment, the clearance between the inner surface of the pipe material 1 and the surface of the mandrel 2 is set to approximately 50 μm to 100 μm. However, the length of the clearance between the inner surface of the pipe material 1 and the surface of the mandrel 2 is not limited to this. The length of the clearance may be any length as long as a resistance between the inner surface of the pipe material 1 and the surface of the mandrel 2 can be reduced by the dry ice powder 3, and may be smaller than 50 μm or larger than 100 μm.

In addition, in the embodiment, dry ice powder 3 is continuously injected during the bending processing. However, the injection of the dry ice powder 3 may be stopped before the bending processing is performed. That is, after the mandrel 2 is inserted up to the processing portion, the dry ice powder 3 is injected. In addition, after a predetermined amount of dry ice powder 3 is injected, the injection of the dry ice powder 3 stops, and the bending processing may be performed after the injection stops. In addition, the injection of the dry ice powder 3 may be intermittent injection in which the injection and the stop are repeated.

Next, operational effects of the first embodiment will be described.

In the present embodiment, the dry ice powder 3 is injected into the pipe material 1 and the bending processing is performed on the pipe material 1. If the dry ice powder 3 is injected into the pipe material 1, the dry ice powder 3 adheres to the inner surface of the pipe material 1 and the surface of the mandrel 2, and a film of the dry ice powder 3 is formed. Accordingly, the resistance generated between the inner surface of the pipe material 1 and the surface of the mandrel 2 during the bending processing is reduced by the dry ice powder 3, and thus, it is possible to prevent distortion or cracking from occurring in the processing portion due to a friction between the inner surface of the pipe material 1 and the surface of the mandrel 2.

In addition, a bending processing portion of the pipe material 1 generates heat by plastic deformation of the pipe material 1 during the bending processing.

However, the film of the dry ice powder 3 is formed inside the pipe material 1, and thus, the dry ice powder 3 absorbs the generated heat to suppress an increase in temperature of the processing portion. Accordingly, it is possible to prevent burning of the inner surface of the pipe material 1 caused by the heat generated by the plastic deformation.

In addition, the dry ice powder 3 is easily vaporized, and thus, the dry ice powder 3 is vaporized inside the pipe material 1 after the bending processing. Accordingly, a liquid or solid residue is not generated in the pipe material 1, a step of removing a lubricant from the inside of the pipe material 1 after the bending processing can be omitted, and thus, overall processing time can be shortened.

In addition, the dry ice powder 3 is injected to the processing portion, and even in a case where foreign materials such as chips are present in the processing portion in the pipe material 1, the foreign materials can be removed from the processing portion by the injection of the dry ice powder 3. Accordingly, even in a case where the foreign materials or the like are mixed in the pipe material 1, it is not necessary to wash the inside of the pipe material 1, and a step of removing the foreign materials can be omitted.

In addition, the dry ice powder 3 is continuously injected during the bending processing, and thus, the dry ice powder 3 is always supplied to the bending processing portion during the bending processing. Accordingly, the heat of the bending processing portion generated during the bending processing is reliably absorbed by the dry ice powder 3, and thus, it is possible to reliably prevent the burning of the processing portion.

In addition, in the present embodiment, the mandrel has a function to inject the dry ice powder 3.

Accordingly, it is not necessary to provide means for injecting the dry ice powder 3 separately from the mandrel 2. Therefore, it is possible to realize a configuration in which the dry ice powder 3 is cheaply injected into the pipe material simply.

A modification example of the method for processing the pipe material 1 using the above-described mandrel 2 will be described. Compared to the first embodiment, in the present modification example, a timing when the mandrel 2 inserted into the pipe material 1 injects the dry ice powder 3 and a time when the injection of the dry ice powder 3 stops are different. Hereinafter, in the modification example, portions common to those of the first embodiment are not described.

First, if the mandrel 2 is inserted into the pipe material 1 and the mandrel 2 reaches a portion positioned in front of the processing portion of the pipe material 1, the insertion of the mandrel 2 stops. Next, the dry ice powder 3 is injected from the mandrel 2. If a predetermined amount of dry ice powder 3 is injected, the injection of the dry ice powder 3 stops. In addition, the insertion of the mandrel 2 starts, the mandrel 2 is inserted up to the processing portion of the pipe material 1, and the bending processing is performed on the pipe material 1. If the bending processing ends, the mandrel 2 is extracted from the inside of the pipe material 1.

Next, operation effects of the modification example will be described.

In the modification example, the insertion of the mandrel 2 is stopped in front of the processing portion, the dry ice powder 3 is injected to the processing portion, the injection of dry ice powder 3 is stopped, and thereafter, the mandrel 2 is inserted into the processing portion. Accordingly, after a layer of the dry ice powder is reliably formed on the inner surface of the pipe material 1 of the processing portion, the mandrel 2 can be inserted into the processing portion. Accordingly, the resistance generated between the inner surface of the pipe material 1 and the surface of the mandrel 2 during the bending processing is appropriately reduced by the dry ice powder 3, and thus, it is possible to prevent distortion or cracking from occurring in a processing portion due to the friction between the inner surface of the pipe material 1 and the surface of the mandrel 2.

In addition, the bending processing is performed after the injection of the dry ice powder 3 is stopped, and thus, a consumption amount of the dry ice powder 3 can be reduced.

Second Embodiment

Next, a second embodiment of the present invention will be described with reference to FIG. 4. The second embodiment is different from the first embodiment in that a porous coating portion 8 is formed on the surface of the mandrel 2. Hereinafter, in the second embodiment, portions common to those of the first embodiment are not described. In addition, in FIG. 4, the flow path (refer to FIG. 1) inside the mandrel 2 is not shown.

In the second embodiment, the coating portion 8 is formed by coating the surface of the mandrel 2 with hard chromium plating. The coating portion 8 has sliding properties better than those of the surface of the mandrel 2. A region in which the coating portion 8 is formed may be the entire region of the mandrel surface and may be a portion thereof. In a case where the coating portion 8 is formed on a portion of the entire region, if the coating portion 8 is formed in a region corresponding to the region of the pipe material 1 in which a surface pressure is generated during the bending processing, it is possible to appropriately reduce the resistance between the inner surface of the pipe material 1 and the surface of the mandrel 2. For example, as the region of the pipe material 1 in which the surface pressure is generated, there are an outer region of the processing portion which is deformed to elongate and an inner region of the processing portion which is deformed to shrink when the bending processing is performed. In addition, in FIG. 4, the coating portion 8 is formed with a recessed portion and a protruding portion in a porous manner, that is, is formed in a porous shape.

In addition, in the present embodiment, the coating portion 8 is formed by applying the hard chrome plating on the mandrel. However, it is not necessary to form the coating portion 8 by the hard chrome plating. For example, the coating portion 8 may be formed by chrome plating.

In addition to the plating film, the coating on the mandrel may be formed by using an individual lubrication film such as a fluororesin (PTFE, PFA, or the like), a nylon resin (MC nylon or the like), a phenolic resin, Diamond Like Carbon (DLC), MoS2, or the like.

Next, an operational effect of the second embodiment will be described.

The coating portion 8 having favorable sliding properties is formed on the surface of the mandrel 2, and thus, even when the dry ice powder 3 is not injected and the film of the dry ice powder 3 is not formed on the mandrel 2, the mandrel 2 can have favorable sliding properties. Accordingly, for example, even in situations in which a function for injecting the dry ice powder 3 of the mandrel 2 is failed and the dry ice powder 3 cannot be injected, it is possible to reduce the resistance generated between the inner surface of the pipe material 1 and the surface of the mandrel 2, and it is possible to prevent distortion or cracking from occurring in the processing portion due to the friction between the inner surface of the pipe material 1 and the surface of the mandrel 2.

Figure 4:
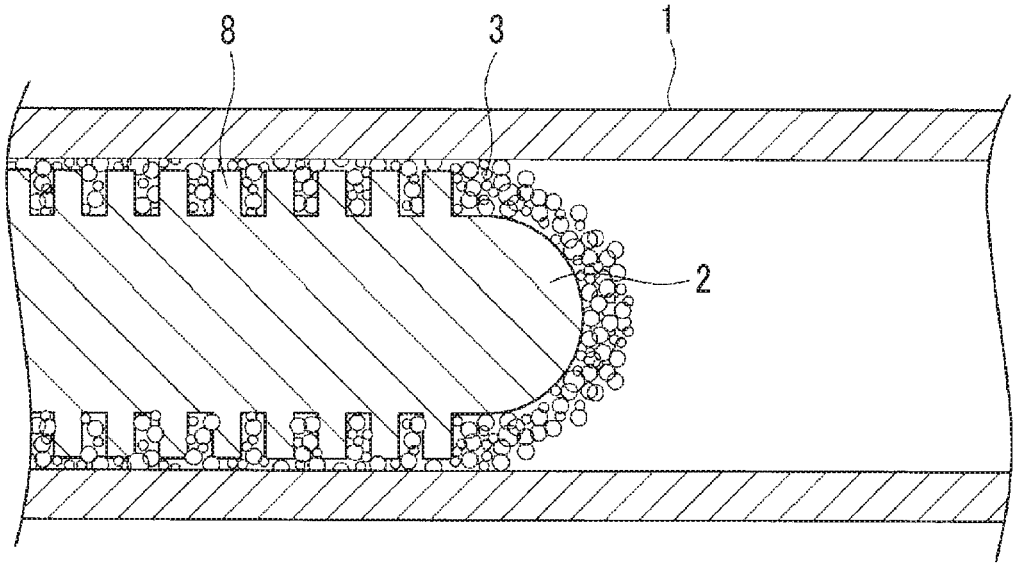
FIG. 4 is a longitudinal sectional view schematically showing a state where a mandrel according to a second embodiment of the present invention holds the dry ice powder inside the pipe material.

The porous coating portion 8 is formed on the surface of the mandrel 2, and thus, the dry ice powder 3 injected from the mandrel 2 is reliably held by the porous coating portion 8 (refer to FIG. 4). Therefore, the film of the dry ice powder 3 is reliably formed on the surface of the mandrel 2, and thus, the resistance generated between the inner surface of the pipe material 1 and the surface of the mandrel 2 is reduced, and it is possible to prevent the distortion or cracking from occurring in the processing portion due to the friction between the inner surface of the pipe material 1 and the surface of the mandrel 2.

In addition, the present invention is not limited to the inventions according to the above-described first and second embodiments, and can be appropriately changed within a scope which does not depart from the gist of the present invention. For example, in the above-described first and second embodiments, the mandrel 2 inserted into the pipe material 1 and the injection means for injecting the dry ice powder 3 into the pipe material 1 are integrated with each other. However, the mandrel 2 and the injection means may be separately formed from each other.

In addition, the film of the dry ice powder 3 formed by the injection of the dry ice powder 3 may not be formed in the entire area of the inner surface of pipe material 1 and the surface of mandrel 2. The film of the dry ice powder 3 may be formed only in the region of the pipe material 1 in which the surface pressure is generated during the bending processing and in the region of the mandrel 2 corresponding to the region of the pipe material 1. As described above, for example, as the region in which the surface pressure is generated, there are the outer region of the processing portion which is deformed to elongate and the inner region of the processing portion which is deformed to shrink when the bending processing is performed.

REFERENCE SIGNS LIST

1: pipe material
2: mandrel
3: dry ice powder
4: flow path
5: main flow path
6: split flow path
7: injection hole
8: coating portion
9: processing device

The invention claimed is:

1. A method for producing a pipe material, comprising:

an insertion step of inserting a mandrel into a pipe material;

an injection step of injecting dry ice powder into the pipe material;

a bending processing step of performing bending processing on the pipe material into which the mandrel is inserted; and an injection stop step of stopping injection of the dry ice powder, wherein the insertion step includes a first insertion step of inserting the mandrel up to a portion positioned in front of a processing portion of the pipe material to be subjected to the bending processing, wherein the injection step includes a preceding injection step of injecting the dry ice powder to the processing portion inside the pipe material from the portion positioned in front of the processing portion after the first insertion step, wherein the injection stop step includes a step of stopping the injection of the dry ice powder after the preceding injection step, and wherein the insertion step includes a second insertion step of inserting the mandrel into the processing portion after the injection stop step.

2. The method for producing a pipe material according to claim 1, wherein in the bending processing step, the dry ice powder is continuously injected.

3. The method for producing a pipe material according to claim 1, wherein the mandrel includes a flow path, through which the dry ice powder flows, inside the mandrel, and an injection hole, through which the dry ice powder is injected, on a tip of the mandrel.

4. The method for producing a pipe material according to claim 1, wherein the mandrel is formed of aluminum, bronze, iron, aluminum alloy, or iron alloy, and wherein a coating portion is formed on a surface of the mandrel, the coating portion being made by chrome plating or chrome plating, or being made of a fluororesin, a nylon resin, a phenolic resin, Diamond like Carbon, or $MoS_2$.

5. The method for producing a pipe material according to claim 1, wherein a porous coating portion is formed on a surface of the mandrel.

6. The method for producing a pipe material according to claim 1, wherein in the injection step, a film of the dry ice powder is formed on an inner surface of the pipe material and a surface of the mandrel.

* * * * *